US010568812B2

(12) United States Patent
Dollinger

(10) Patent No.: US 10,568,812 B2
(45) Date of Patent: Feb. 25, 2020

(54) DEVICE FOR SEPARATING PARTICLE FRAGMENTS FROM SAID PARTICLES

(71) Applicant: PHARMA TECHNOLOGY SA, Thines (Nivelles) (BE)

(72) Inventor: Martial Dollinger, Braine L'Alleud (BE)

(73) Assignee: PHARMA TECHNOLOGY SA, Thines (Nivelles) (BE)

( * ) Notice: Subject to any disclaimer, the term of this patent is extended or adjusted under 35 U.S.C. 154(b) by 0 days.

(21) Appl. No.: 15/757,193

(22) PCT Filed: Sep. 7, 2016

(86) PCT No.: PCT/EP2016/071060
§ 371 (c)(1),
(2) Date: Mar. 2, 2018

(87) PCT Pub. No.: WO2017/042202
PCT Pub. Date: Mar. 16, 2017

(65) Prior Publication Data

US 2018/0311109 A1 Nov. 1, 2018

(30) Foreign Application Priority Data

Sep. 7, 2015 (BE) ..... 2015/0228

(51) Int. Cl.
*B07B 1/50* (2006.01)
*A61J 3/07* (2006.01)
(Continued)

(52) U.S. Cl.
CPC ..... *A61J 3/074* (2013.01); *B07B 1/469* (2013.01); *B07B 1/55* (2013.01); *B07B 13/04* (2013.01)

(58) Field of Classification Search
CPC .. B07B 1/469; B07B 1/50; B07B 1/55; B07B 13/04; B07B 1/52; B07B 1/526; B07B 1/528; A61J 3/074
(Continued)

(56) References Cited

U.S. PATENT DOCUMENTS 1,663,027 A * 3/1928 Sorensen ..... A01F 12/446 209/387
1,981,081 A * 11/1934 Simpson ..... B07B 1/38 209/266
(Continued)

FOREIGN PATENT DOCUMENTS

CN 104384095 A * 3/2015 ..... B07B 1/50
EP 0251349 A1 * 1/1988 ..... B07B 1/08
(Continued)

OTHER PUBLICATIONS

English Translation of CN 104384095 A; Inv: Ding et al.; Pub. Date: Mar. 2015 (Year: 2015).*
(Continued)

*Primary Examiner* — Jospeh C Rodriguez
(74) *Attorney, Agent, or Firm* — Christensen O'Connor Johnson Kindness PLLC

(57) ABSTRACT

A device for separating broken fragments of particles from the particles, comprising a floor arranged such that it receives the particles and the broken fragments, connected to a vibration device arranged such that it makes the floor undergo a vibratory movement, the floor being pierced with orifices to allow the broken fragments to pass through the orifices without allowing the particles to pass therethrough, and a ceiling arranged substantially parallel to the floor. The device further comprises an actuator arranged so as to move the ceiling between a first position in which it is located at a distance from the floor and a second position in which it
(Continued)

is in contact with the floor such that the broken particle fragments stuck in the orifices are expelled therefrom.

20 Claims, 3 Drawing Sheets

(51) Int. Cl.
*B07B 1/46* (2006.01)
*B07B 1/55* (2006.01)
*B07B 13/04* (2006.01)

(58) Field of Classification Search
USPC ..... 209/379, 384, 387
See application file for complete search history.

(56) References Cited

U.S. PATENT DOCUMENTS 2,086,821 A * 7/1937 Raisch ..... E02B 8/026 209/379
2,119,676 A * 6/1938 Heller ..... B07B 1/18 209/288
4,181,603 A 1/1980 Fox
4,289,614 A * 9/1981 Suzuki ..... A23N 15/00 209/308
4,396,511 A * 8/1983 Neumann ..... E02B 8/026 210/159
4,421,642 A * 12/1983 Kreitner ..... B07B 1/50 15/246
4,637,557 A * 1/1987 Vitunac ..... B02C 13/284 209/384
5,799,799 A * 9/1998 Alamzad ..... B07B 1/42 209/365.1
5,819,951 A * 10/1998 Sultanovich ..... B07B 1/4654 209/313
5,873,973 A * 2/1999 Koon ..... B29C 70/24 156/160
6,129,215 A * 10/2000 Brauch ..... B01D 29/01 209/273
7,059,479 B2 * 6/2006 Krahl ..... B07B 13/04 209/540
8,678,197 B2 * 3/2014 Koike ..... A61J 7/0007 209/314
8,869,989 B2 * 10/2014 Gallagher ..... D21D 5/026 162/55
9,403,193 B1 * 8/2016 Picard, Jr. ..... B07B 1/50
9,623,446 B2 * 4/2017 Iwamatsu ..... B07B 1/12
2013/0112599 A1 * 5/2013 Cristobal ..... B07B 1/34 209/235

FOREIGN PATENT DOCUMENTS

FR 2434656 A1 3/1980
FR 2841161 A1 12/2003

OTHER PUBLICATIONS

International Search Report dated Dec. 5, 2016, issued in corresponding International Application No. PCT/EP2016/071060, filed Sep. 7, 2016, 2 pages.
Written Opinion of the International Searching Authority dated Dec. 5, 2016, issued in corresponding International Application No. PCT/EP2016/071060, filed Sep. 7, 2016, 6 pages.
Written Opinion of the International Searching Authority dated Dec. 5, 2016, issued in corresponding International Application No. PCT/EP2016/071060, filed Sep. 7, 2016, 9 pages.
International Preliminary Report on Patentability dated Mar. 13, 2018, issued in corresponding International Application No. PCT/EP2016/071060, filed Sep. 7, 2016, 1 page.

* cited by examiner

DEVICE FOR SEPARATING PARTICLE FRAGMENTS FROM SAID PARTICLES

FIELD OF THE DISCLOSURE

Embodiments of the disclosure relate to a device for separating broken particle fragments from the particles and a method for implementing the device. Such devices are used in various industries for separating particles of a first shape, from broken fragments of the particles with which the former are mixed, such broken fragments in particular capable of resulting from the breakage of the particles during their manufacturing process. In particular, in the pharmaceutical industry, the particles are constituted from tablets or capsules, and it is important that only whole tablets or capsules are carried to the packing line thereof in containers grouping together a certain number of the tablets or capsules for the marketing thereof.

BACKGROUND

Such a device generally comprises a floor arranged such that it receives particles of a specific shape and broken fragments of such particles, connected to a first means arranged such that it makes the floor undergo a vibratory movement such that the particles and broken fragments in question move on the floor in a direction determined by the type of vibratory movement it is made to undergo, the floor being pierced with orifices of a shape predetermined as a function of the shape of the particles, in order to allow the broken fragments of such particles to pass through the orifices without allowing the particles themselves to pass therethrough.

For example, the two dimensions (length, width) of such an orifice can be slightly greater than two of the three dimensions (length, width, height) of a particle, however less than the third dimension thereof. Therefore, a broken particle fragment, the third dimension of which is reduced relative to that of a whole particle, can easily fall into the orifice in question, whereas a whole particle could only fall therethrough by being tilted along an axis of symmetry that is orthogonal to the third dimension. In such a case, the fraction of whole particles that has nonetheless passed through the floor of the device by way of some of the orifices thereof can be recovered upstream using appropriate means. Such a device generally further comprises a ceiling arranged substantially parallel to the floor of the device.

Document FR2841161, for example, discloses such a device.

One problem caused by such devices is that the broken fragments, the third dimension of which is greater than or equal to at least one of the two dimensions of the orifices of the floor of the device can become stuck in the orifices and thus block same. In such a situation, as the process for separating the broken fragments from the whole particles by the device progresses, an increasing number of orifices can become blocked in this manner, which reduces the separating efficiency of the device to an equal degree.

In such a situation, the operation of the device is usually stopped in order to manually, or by way of mechanical means, unblock the orifices in which the broken particle fragments have become stuck. This operation therefore results in a loss of time and therefore of productivity and an additional workforce is required to perform the operation.

SUMMARY

The disclosure solves the aforementioned problem by proposing a device of the type described above, however which further comprises a second means arranged such that it can move the ceiling of the device between a first position and a second position in which it is in contact with the floor such that the broken particle fragments stuck in the orifices are expelled therefrom.

In document FR2841161, the ceiling, called a plate, is used to control the position of the particles, however remains at a set distance relative to the floor. The device disclosed therein therefore does not allow the orifices to be unblocked.

Preferably, the first means is a vibrating means. Preferably, the first means is mechanically connected to the floor. Preferably, the floor and the ceiling are mechanically coupled to each other. Preferably, the second means is mechanically coupled to the ceiling.

Embodiments of the disclosure further relate to a method for separating broken particle fragments of a first shape from the particles, comprising the steps of:

- Due to a second means arranged for this purpose, positioning a ceiling substantially parallel to a floor in a first position in which it is located at a distance from a floor arranged so as to receive particles and broken fragments of the particles, the floor being pierced with orifices;
- Making the floor undergo a vibratory movement due to a first means arranged for this purpose;
- Adding particles and broken fragments of such particles between the floor and the ceiling;
- Stopping the addition at a predetermined time;
- Stopping the vibratory movement of the floor once there are no more tablets or broken fragments on the surface thereof facing the ceiling;
- Moving, due to the second means, the ceiling between the first position thereof and a second position in which it is in contact with the floor such that the broken particle fragments stuck in the orifices are expelled therefrom.
- Moving, due to the second means, the ceiling from the second position thereof to the first position thereof.

These steps are performed in the order stipulated hereinabove.

Due to the aforementioned second means, broken particle fragments stuck in the orifices of the floor of the device can be periodically expelled therefrom by the application of pressure on the broken fragments by the ceiling of the device when it is brought into the second position thereof in which it is substantially in contact with the surface of the floor facing the ceiling in question. This therefore solves the aforementioned problem as the orifices thus cleared return to full operation. Therefore the ceiling of the device must simply be moved from the first to the second position thereof when no particles or broken fragments are still in contact with the surface and only broken fragments are present, stuck in the orifices of the floor of the device, in order allow the device to retain its functional quality over time, unlike with devices according to the prior art.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

Figure 1:
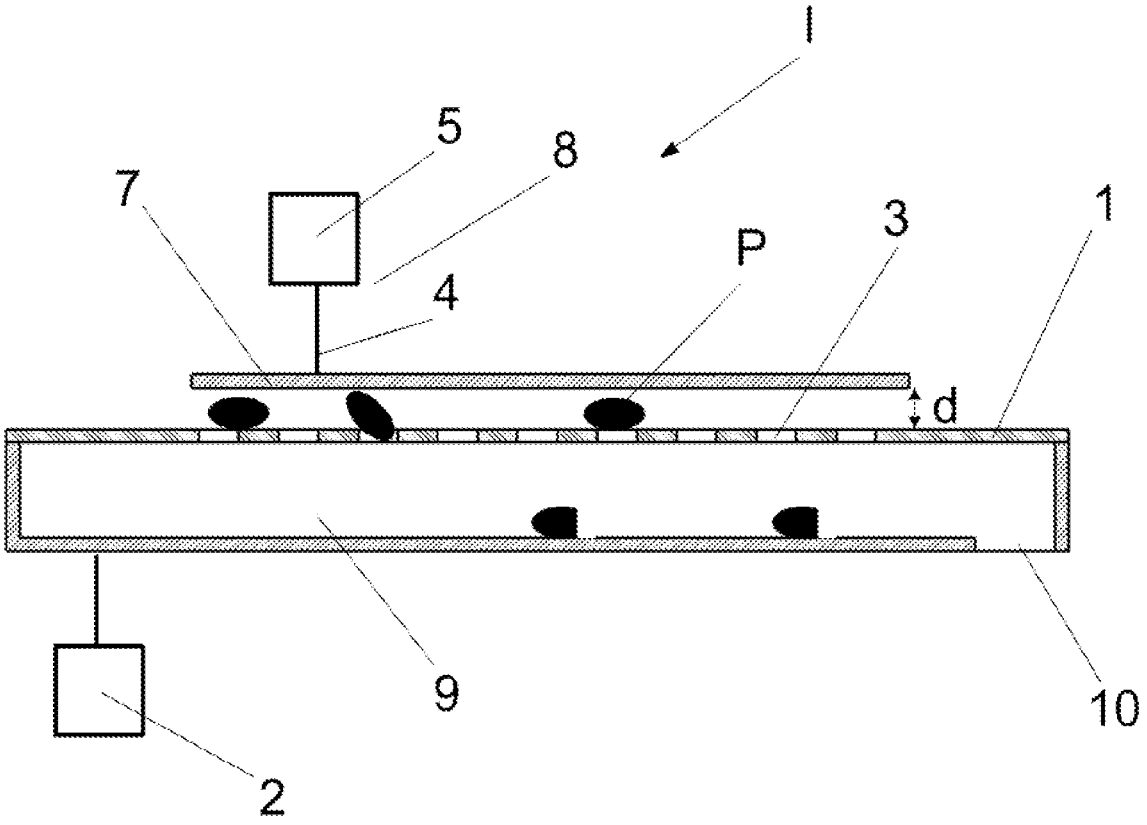
FIG. 1 is a vertical sectional view of a device according to the disclosure in the first position of the ceiling comprised therein.
Figure 2:
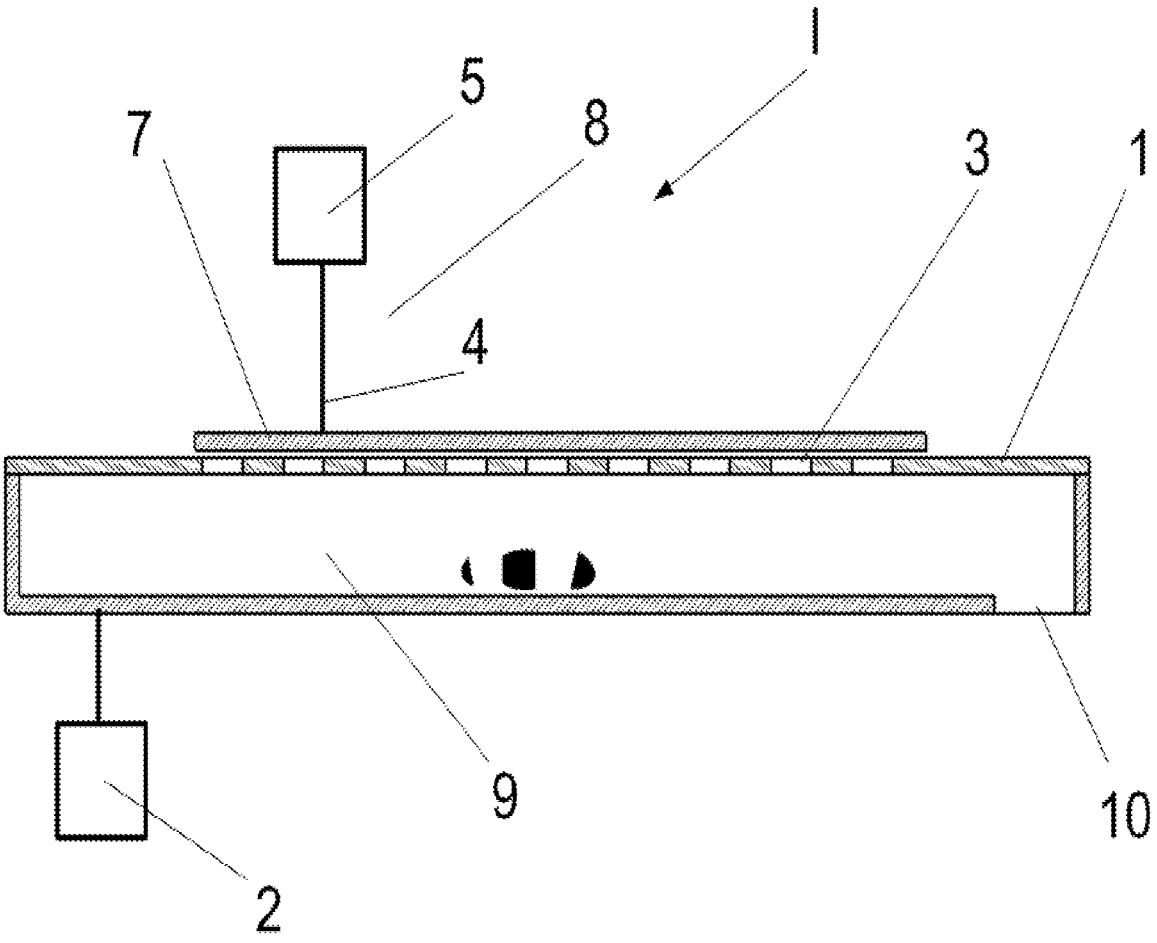
FIG. 2 is a vertical sectional view of the device shown in FIG. 1 in the second position of the ceiling comprised therein.
Figure 3:
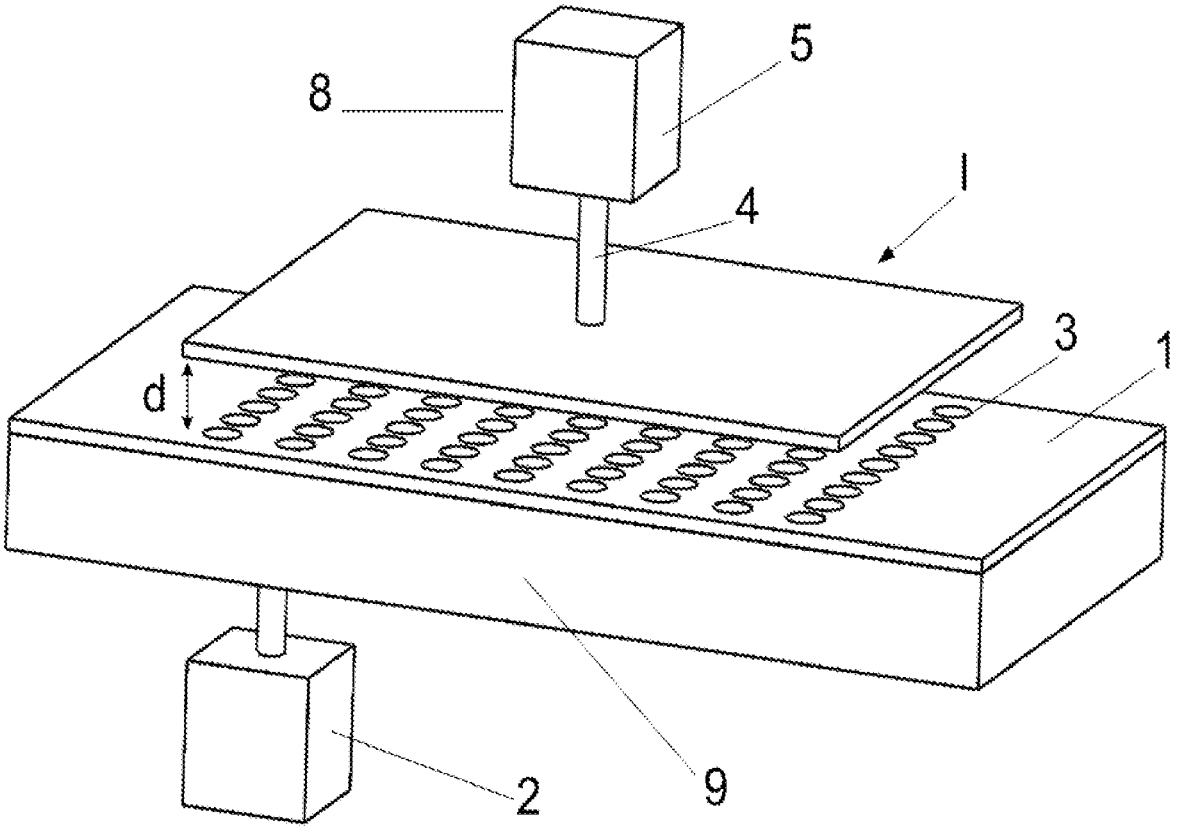
FIG. 3 is a perspective view of the device according to FIG. 1.

With reference to the accompanying FIGURES, a device I is shown for separating broken particle fragments p of a first shape, from the particles, comprising a floor 1 arranged such that it receives the particles and the broken fragments, connected to a first means 2 arranged such that it makes the floor undergo a vibratory movement, the floor being pierced with orifices 3 of a second shape predetermined as a function of the first shape, in order to allow the broken fragments to pass through the orifices, without allowing the particles to pass therethrough, a ceiling 7 arranged substantially parallel to the floor; the device further comprising a second means 8 arranged so as to be able to move the ceiling between a first position in which it is located at a distance d from the floor predetermined as a function of the smallest of the three dimensions of the particles (see FIG. 1) and a second position in which it is substantially in contact with the floor such that the broken particle fragments stuck inside the orifices are expelled therefrom (see FIG. 2). The distance d in question is chosen such that it is slightly greater than the smallest dimension of the particles. In this manner, each particle is made to move in the device on the floor thereof such that the axes of symmetry thereof according to each of the other dimensions thereof are positioned parallel to the floor in question. This prevents a particle from being tipped into one of the orifices of the floor about an axis of symmetry that is orthogonal to the largest dimension of the particle. Therefore, the efficiency of the device for separating particles from the broken fragments thereof is advantageously improved.

In other words, according to one embodiment, the distance d is chosen such that the particles are lying down on the floor 1, the maximum extension thereof being parallel to the floor 1. The size of the orifices 3 is chosen so that any particle having such a maximum extension parallel to the orifices 3 cannot pass through the orifices. Moreover, the particles are also unable to tip into the orifices as the tipping movement is blocked by the ceiling 7.

Preferably, as shown in the FIGURES, the second means 8 comprises a cylinder 4 connected to the ceiling and a motor 5 arranged such that it moves the cylinder between the first and the second position of the ceiling.

In one embodiment, the second means 8 comprises an electronic control unit for controlling the motor 5. Upon instruction from the electronic unit, the motor 5 brings the ceiling 7 into contact with the floor 1. For example, the electronic control unit can instruct the motor 5 to perform such a movement once per periodic cycle. Such a periodic cycle can have a period that preferably lies in the range one minute to one hour, more preferably in the range two minutes to thirty minutes, even more preferably in the range five minutes to fifteen minutes.

The control of the motor 5 can be automated due to the electronic control unit. The periodic and automated movement of the ceiling 7 allows the broken fragments stuck in the orifices 3 to be periodically and automatically ejected therefrom. This makes the device according to the disclosure particularly advantageous in an industrial process.

The motor 5 can be a servomotor.

The floor is preferably arranged in a removable manner in the device, i.e. such that it can be removed from the device. Therefore, a plurality of floors, each of which has orifices of a different predetermined second dimension, suited to a first different particle shape can be alternatively included in the device as a function of the first specific shape of the particles to be separated from the broken fragments thereof by the device, which makes the use thereof highly versatile.

The device as shown further comprises a bin 9 for collecting the broken particle fragments arranged beneath the floor of the device, the bin itself being provided with an opening 10 arranged in the bin to allow the broken fragments collected therein to be removed from the device.

Within the scope of this disclosure, the aforementioned particles can be pharmaceutical tablets or capsules.

The particles preferably have a cylindrical symmetry, with an axial extension that exceeds a radial extension. The particles can have an axial and/or radial extension that lies in the range 2.5 to 25 mm, preferably in the range 5 to 10 mm, and more preferably in the range 7 to 8 mm.

Alternatively, the particles can have a spherical symmetry. The particles can have a radius that lies in the range 2.5 to 25 mm, preferably in the range 5 to 10 mm, and more preferably in the range 7 to 8 mm.

In one embodiment, the orifices are circular. Preferably, they have a diameter that lies in the range 2.5 to 25 mm, more preferably in the range 5 to 10 mm, and even more preferably in the range 7 to 8 mm.

The distance d (FIG. 1) between the ceiling 7 and the floor 1 in the first position is preferably 1 mm greater than the radial extension of the particles if the latter have a cylindrical symmetry, and 1 mm greater than the radius of the particles if the latter have a spherical symmetry. For example, the distance d preferably lies in the range 3.5 to 26 mm, more preferably in the range 6 to 11 mm, and even more preferably in the range 7 to 8 mm.

According to one embodiment, the device I according to the disclosure is a device for separating broken particle fragments p of a first shape, from the particles, comprising a floor 1 arranged such that it receives the particles and the broken fragments, connected to a first means 2 arranged such that it makes the floor undergo a vibratory movement, the floor being pierced with orifices 3 of a second shape predetermined as a function of the first shape, in order to allow the broken fragments to pass through the orifices, without allowing the particles to pass therethrough, a ceiling 7 arranged substantially parallel to the floor; and comprising a second means 8 arranged so as to be able to move the ceiling between a first position in which it is located at a distance d from the floor predetermined as a function of the smallest of the three dimensions of the particles and a second position in which it is substantially in contact with the floor such that the broken particle fragments stuck inside the orifices are expelled therefrom.

According to one embodiment, the method according to the disclosure is a method for separating broken particle fragments (p) of a first shape from the particles, comprising the steps of:

(i) Due to a second means 8 arranged for this purpose, positioning a ceiling 7 substantially parallel to a floor 1 in a first position in which it is located at a distance d from a floor arranged so as to receive particles and broken fragments of the particles, the floor being pierced with orifices 3 of a second shape predetermined as a function of the first shape so as to allow the broken fragments to pass through the orifices, without allowing the particles to pass therethrough, the distance d being predetermined as a function of the smallest of the three dimensions of the particles;

(ii) Making the floor undergo a vibratory movement due to a first means 2 arranged for this purpose;

(iii) Adding particles p and broken fragments of such particles between the floor and the ceiling;

(iv) Stopping the addition at a predetermined time;

(v) Stopping the vibratory movement of the floor once there are no more tablets or broken fragments on the surface thereof facing the ceiling;

(vi) Moving, due to the second means, the ceiling between the first position thereof and a second position in which it is substantially in contact with the floor such that the broken particle fragments stuck in the orifices are expelled therefrom; and (vii) Moving, due to the second means, the ceiling from the second position thereof to the first position thereof.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The invention claimed is:

1. A device for separating broken fragments of particles from said particles, comprising:

a floor including a plurality of orifices and arranged to receive said particles and said broken fragments;

a vibrator connected to said floor and arranged to make said floor undergo a vibratory movement;

a ceiling arranged parallel to said floor, wherein the ceiling is a solid plate; and means arranged so as to be able to move said ceiling between a first position in which said ceiling is located at a non-zero distance from the floor and a second position in which said ceiling is in contact with the floor.

2. The device according to claim 1, wherein said means comprises a cylinder connected to said ceiling and to a motor arranged to move the cylinder between the first and the second position of the ceiling.

3. The device according to claim 2, wherein the motor is a servomotor.

4. The device according to claim 2, wherein said means further comprises an electronic control unit connected to the motor and arranged to control said motor.

5. The device according to claim 4, wherein said electronic control unit is programmed to periodically bring the ceiling into contact with the floor via said motor.

6. The device according to claim 1, wherein said floor is arranged in a removable manner in said device.

7. The device according to claim 1, further comprising a bin for collecting said broken fragments arranged beneath said floor.

8. The device according to claim 7, wherein an opening is arranged in said bin to allow the broken fragments to be removed.

9. The device according to claim 1, wherein the distance lies in the range of 3.5 to 26 mm.

10. The device according to claim 1, wherein the orifices are circular and have a diameter that lies in the range of 2.5 to 25 mm.

11. The device according to claim 1, further comprising a feed plate overlooking the floor and laterally offset relative thereto, in order to feed the particles and the broken fragments of particles onto the floor.

12. A system for separating broken fragments of particles from said particles, comprising:

particles of a first shape;

broken fragments of said particles; and a device according to claim 1, wherein the orifices have a second shape and wherein the distance and the second shape of the orifices are such that the orifices are capable of allowing said broken fragments to pass through the orifices, without allowing said particles to pass through the orifices.

13. A method for separating broken fragments of particles from said particles, comprising the following steps:

(i) positioning a ceiling parallel to a floor in a first position in which said ceiling is located at a distance from said floor, the floor being arranged so as to receive particles and broken fragments of said particles, said floor being pierced with orifices;

(ii) vibrating the floor;

(iii) adding particles and broken fragments of such particles between the floor and the ceiling;

(iv) stopping said addition of particles at a predetermined time;

(v) stopping the vibration of the floor once there are no more particles or broken fragments of particles on one of the surfaces thereof facing the ceiling;

(vi) moving the ceiling between the first position thereof and a second position in which said ceiling is in contact with the floor such that the broken fragments of particles stuck in the orifices are expelled therefrom; and (vii) moving the ceiling from the second position thereof to the first position thereof, wherein the ceiling is a solid plate.

14. The method according to claim 13, wherein steps (iv) and (v) are offset in time, such that the floor continues to vibrate during a timeslot after step (iv) to remove the particles and broken fragments of particles from the floor.

15. The method according to claim 13, wherein steps (ii) to (vii) are repeated at least once after step (vii).

16. The method according to claim 13, wherein steps (ii) to (vii) are repeated periodically after step (vii).

17. The device of claim 9, wherein the distance lies in the range of 6 to 11 mm.

18. The device of claim 10, wherein the orifices have a diameter that lies in the range of 5 to 10 mm.

19. The device of claim 1, wherein the ceiling is configured to cause a broken fragment stuck in one of said orifices to be expelled therefrom.

20. A device for separating broken fragments of particles from said particles, comprising:

a floor including a plurality of orifices, said floor arrange to receive said particles and said broken fragments;

a vibrator connected to said floor and arranged to make said floor undergo a vibratory movement;

a ceiling arranged parallel to said floor, wherein the ceiling is a solid plate; and an actuator configured to move said ceiling perpendicularly to the floor between a first position in which said ceiling is located at a non-zero distance from the floor and a second position in which said ceiling is in contact with the floor.

* * * * *